United States Patent [19]

Woodworth

[11] Patent Number: 4,664,468

[45] Date of Patent: May 12, 1987

[54] BATTERY CONNECTOR

[76] Inventor: Albert H. Woodworth, 1777 Whittier Ave., Costa Mesa, Calif. 92627

[21] Appl. No.: 769,752

[22] Filed: Aug. 23, 1985

Related U.S. Application Data

[63] Continuation of Ser. No. 442,440, Nov. 17, 1982, abandoned.

[51] Int. Cl.[4] ..... H01R 11/26

[52] U.S. Cl. ..... 339/239; 339/238

[58] Field of Search ..... 339/236, 238, 239, 218 R

[56] References Cited

U.S. PATENT DOCUMENTS

| | | | |
|---|---|---|---|
| 1,805,857 | 5/1931 | Trimble et al. | 339/239 |
| 1,920,608 | 8/1933 | Thompson | 339/239 |
| 3,047,834 | 7/1962 | Ausherman | 339/236 |
| 3,397,382 | 8/1968 | Shannon | 339/230 |
| 3,945,708 | 3/1976 | Griffin | 339/218 R |
| 4,181,394 | 1/1980 | Dodge | 339/218 R |
| 4,460,231 | 7/1984 | Muz | 339/218 R |
| 4,555,159 | 11/1985 | Chartrain et al. | 339/239 |

*Primary Examiner*—Gil Weidenfeld
*Assistant Examiner*—Paula A. Austin
*Attorney, Agent, or Firm*—Allston L. Jones

[57] ABSTRACT

A connector for making connections to the post of an automotive lead-acid battery is disclosed. The connector includes a body portion having a pair of bifurcated ring portions each defining a circular opening therethrough, and a locking ring portion, also defining a circular opening therethrough with a pair of lugs affixed to the locking ring. The circular openings of each are designed to slip over and surround the battery post and when the locking ring is turned by means of the lugs, the lugs come into contact with the ring portions of the body causing the three rings to cut into the battery post around its total circumference by cam action and to lock in position by friction.

5 Claims, 9 Drawing Figures

BATTERY CONNECTOR

CROSS REFERENCE TO RELATED APPLICATION

This is a continuation of application Ser. No. 442,440, filed Nov. 17, 1982, now abandoned.

BACKGROUND & SUMMARY OF THE INVENTION

This invention relates to connectors for making low resistance electrical connections to batteries, namely connectors for making electrical connections to lead-acid automotive batteries.

The prior art includes connectors of the types shown in FIGS. 1 and 2. These connectors present two problems, the first being that only a minimum of the circumferential surface of the battery post is contacted by the connector as the connection bolt is tightened. This results from the deformation of the circular opening defined by the connector as the bolt is tightened. This deformation is inherent in this method of connector tightening.

The second problem, and one that contributes to automotive starting problems, is the corrosion of the connector. This increases the electrical resistance between the connector and the battery post and thus limiting the electrical current flow from the battery during high current usage functions such as starting of the engine. Corrosion also limits the ability of the automotive generator or alternator to recharge the battery. Corrosion results from the use of dissimilar metals which are used in connectors of this type—the lead alloy body and the steel tightening bolt. Whenever, dissimilar metals come into contact there is a natural electro-molecular action between them. Then, when acid fumes are added, this process is accelerated resulting in visible corrosion.

The connector of the present invention provides a connector of a single material which maximizes the surface area of the battery post with which a low resistance electrical contact is made. This connector is a two piece connector with each piece manufactured from the same alloy. The connector includes a body portion for attachment to a cable. It includes a bifurcated portion which defines a pair of spaced-apart ring portions. Each ring-portion defines a circular opening therethrough with its center offset from the center of the respective ring portion. Each of these circular openings are aligned, one with the other and are sized to fit around the tapered battery post.

The second piece of the connector is a locking ring which includes a tab extending outward from the ring with a pair of lugs, one each extending upward and downwad from the planes defined by each side of the ring. The thickness of the ring is sized to permit the insertion of the ring between the two ring portions of the body with the circular opening through the locking ring being substantially the same diameter as the diameters of the circular openings in the body ring portions.

To make the connection to a battery post, the locking ring is inserted into the body in the unlocked position with all three of circular openings aligned. The connector is then slipped onto the battery post. To tighten the connector, the locking ring is turned in either direction causing a constriction of the circular opening of the assembled connector by cam action as the lugs ride on the edge of the body ring portions forcing the circular opening in the locking ring portion out of alignment with the other circular openings. This is caused by the variable wall thickness of the circular openings in the body ring portions which are the result of the offsetting of the center of those circular openings from the center of the body ring portions.

DESCRIPTION OF THE PREFERRED EMBODIMENT

Figure 1:
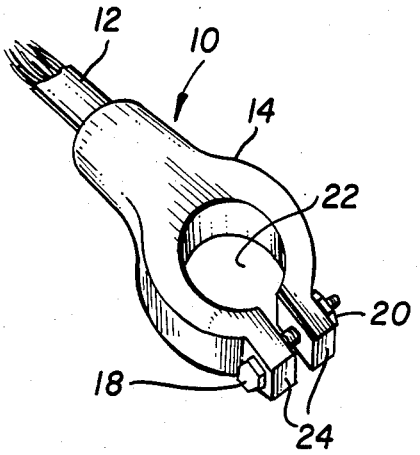
FIG. 1 PRIOR ART
FIGS. 1 and 2 are isometric views of lead-acid battery connectors of the prior art.
Figure 2:
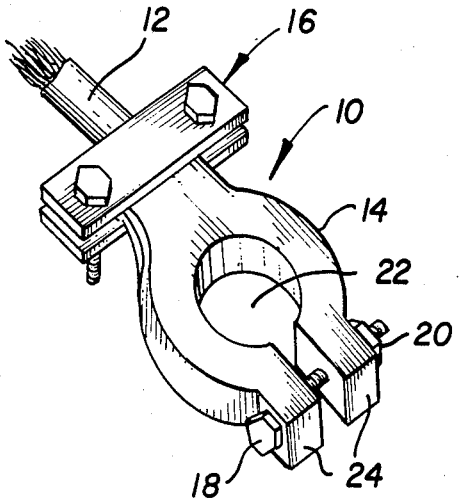
FIG. 2 PRIOR ART

FIGS. 1 and 2 show two designs of the prior art automotive lead-acid battery connectors 10. The connector 10 of FIG. 1 is manufactured by molding the body 14 of the connector directly onto the copper strands of cable 12. Connector 10 of FIG. 2, on the other hand, is a replacement type connector which is made for clamping the connector body 14 to an existing cable 12 in the "after market". The FIG. 2 connector body 14 includes a bridge clamp and bolts assembly 16 for securing body 14 to the copper strands of cable 12. In a typical after market connector, the bridge clamp and bolts 16 will be fabricated from steel, whereas the body 14 of both connectors (FIGS. 1 and 2) are typically 97% lead and 3% antimony, with the antimony being added to the lead for hardening.

In both of the prior art designs, the connector body 14 consists of a vertically split ring defining a central, substantially circular opening 22 with two substantially parallel tightening lobes 24 extending outward from the central opening on either side of the split. The diameter of the central opening is manufactured to be somewhat larger than the diameter of a standard battery post to facilitate installation. To tighten the connector 10 around a battery post 26 (see FIG. 3) a steel bolt 18 is passed through pre-drilled holes in tightening lobes 24 and a steel nut 20 is threaded onto the bolt to cause tightening lobes 24 to be drawn together as bolt 18 and nut 20 are tightened.

Figure 3:
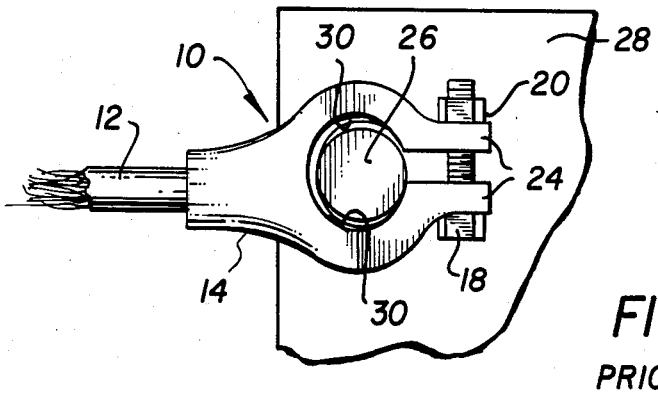
FIG. 3 PRIOR ART
FIG. 3 is a view of a prior art type lead-acid battery connector connected to a post of such a battery.

In FIG. 3 it can be seen that as tightening lobes 24 are drawn closer together by means of bolt 18 and nut 20, the central opening 22 of connector 10 deforms from its original circular shape. The result is that connector 10 does not make continuous contact with the circumferential surface of battery post 26. Gaps 30 result. In addition, since battery posts are generally tapered with a smaller diameter at the top than at the bottom, connector 10 after tightening of bolt 18 and nut 20 is making a more complete connection with post 26 along its side closest to the surface of battery 28 than it is on its upper side. In fact, connector 10 may make contact with post 26 over less than half the connector surface designed to make such contact. The less surface area of connector 10 in contact with post 26, the higher the electrical resistance of that connection.

Another problem that is typical of connections to lead-acid batteries is the all too familiar corrosion. This results from the molecular action between the two dissimilar metals, lead and steel of the connectors 10. That molecular action is accelerated by the presence of the acid fumes from battery 28.

To overcome the problems with the prior art connectors, the present invention minimizes the use of dissimilar metals for the connectors and maximizes the area of contact of the connector with the battery post.

Figure 4A:
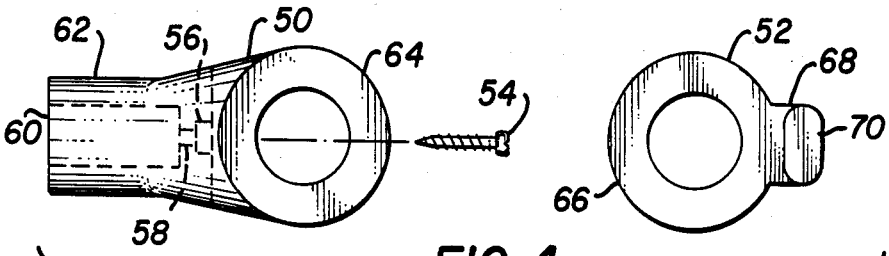
FIGS. 4*a* and *b* show top and side exploded views of a connector of the present invention.
Figure 4B:
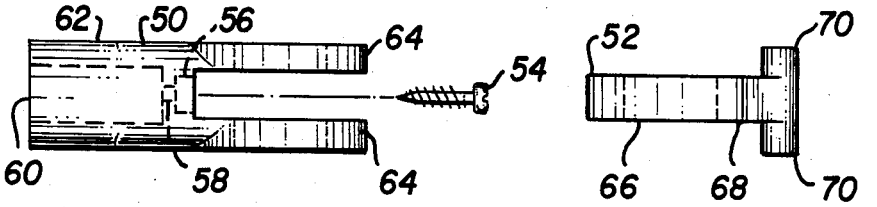

In FIG. 4*a* and *b* there is shown a top and a side view of the constituent parts of the connector of the present invention, the body 50 and the locking ring 52. As with the prior art connector, the body 50 may be molded onto a cable or connected to a cable for use in the after market. The after market type connector of the present invention is shown in FIGS. 4*a* and *b*. For use in the after market the cable insulation is first stripped back sufficiently to fully seat the exposed copper strands within cavity 60 (shown dotted) within the end of body 50. To attach body 50 to the cable, screw 54 is introduced through channel 58 and tightened until its head is fully within seat 56. Attachment is achieved by the introduction of the shaft of screw 54 into cavity 60 thus forcing the copper strands of the cable against the interior surface of cavity 60 within body 50. Screw 54 is only necessary for after market uses.

Body 50 includes a shank portion 62 for attachment to a cable and a pair of bifurcated, spaced-apart ring portions 64 defining the top and bottom of the body 50. Each of ring portions 64 are substantially circular in shape with each defining a circular opening therethrough with these circular openings aligned one above the other. The upper ring portion 64 typically will have a circular opening that is slightly smaller in diameter than the circular opening in the lower ring portion 64. This is to better accommodate the tapered battery post. It should also be noted that the center of the circular opening in both the upper and lower ring portions 64 is offset from the center of the circular ring portions. The width of the ring surrounding the circular openings being narrowest at the end of the body portion 50 farthest from the end to which the cable is connected and widening linearly as the circumference of the ring portion 64 is traversed both clockwise and counterclockwise from that position.

Locking ring 52 includes a ring portion 66 having a substantially uniform width surrounding a circular opening therethrough with the diameter of that opening being substantially the average of the diameters of the circular openings in each of the ring potions 64 of body 50. The thickness of ring portion 66 is substantially equal to the spacing between ring portions 64 of body 50. Additionally, locking ring 52 includes tab 68 with lugs 70 extending above and below the surfaces of ring portion 66. Lugs 70 are disposed to be adjacent the edges of ring portions 64 of body 50 when locking ring 52 is inserted into body 50 as described below in the discussion relative to FIGS. 5*a* and *b*, and 6*a* and *b*.

Figure 5A:
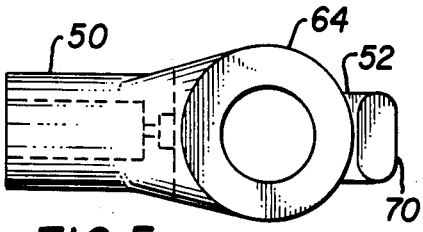
FIGS. 5*a* and *b* show a connector of the present invention with the central ring in an extreme unlocked position.

FIGS. 5*a* and *b* show locking ring 52 installed between ring portions 64 of body 50. In these figures locking ring 52 is in the unlocked position with the circular openings of locking ring 52 and ring portions 64 of body 50 in alignment for insertion onto a standard battery post. Note that in the unlocked position, lugs 70 are spaced-apart from the ends of the ring portions 64 of body 50.

Figure 6A:
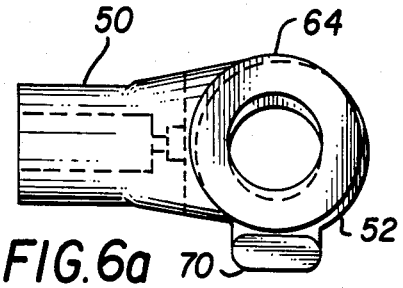
FIGS. 6*a* and *b* show a connector of the present invention with the central ring in an extreme locked position.
Figure 6B:
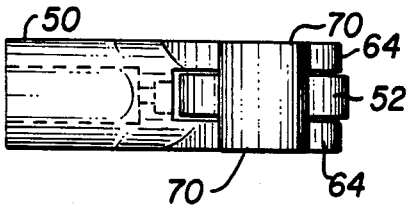
Figure 5B:
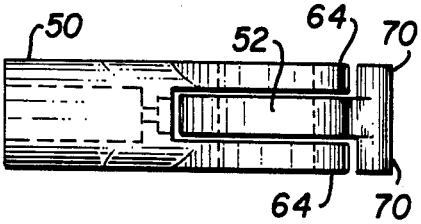

FIGS. 6*a* and 6*b* show locking ring 52 in a locking position. In these figures locking ring 52 has been turned clockwise through approximately 90° from the position shown in FIGS. 5*a* and *b*. It can be seen that the circular opening of locking ring 52 can no longer be kept in alignment with the circular openings in the body 50 ring portions. This results from the offsetting of the center of the circular openings in the body 50 ring portions 64 from the center of the circumferential circle defining the outline ring portions 64. Thus, the rim surrounding the circular openings of ring portions 64 and lugs 70, by cam action, attempts to draw the circular opening of locking ring 52 out of alignment with the circular openings in ring portions 64. Therefore, if the connector of the present invention were on a battery post and locking ring 52 were turned to a locking position (either clockwise or counterclockwise), the battery post would resist the misalignment action of the circular openings during the locking step, resulting in lugs 70 being forced against the rim of ring portions 64 resulting in the locking ring 52 cutting into approximately 180° of the circumferential surface of the battery post and the ring portions 64 cutting into the opposing 180° of the circumferential surface of the battery post.

In the locked position, the surface area of contact with the battery post is continuous around its circumference with the area of contact being maximized to insure a low electrical resistance connection. Lock of the connector is maintained without bolts by friction between lugs 70 and the rims of ring portions 64.

A compound of 91% lead and 9% antimony for these connectors has been tested and found to provide the necessary strength during attachment and removal of the connector to prevent breakage.

A connector of this design not only provides a means for quick connection and release to or from a lead-acid battery post, it also minimizes the possibility of corrosion of the connectors by virtue of the minimization of the use of dissimilar materials in its construetion.

From the foregoing description, it will be apparent that the invention disclosed herein provides a novel and advantageous battery connector. As will be understood by those familiar with the art, the invention may be embodied in the specific forms without departing from the spirit or essential characteristics thereof.

I claim:

1. A non-corroding connector for making low electrical resistance connections between a cable and a battery post, said connector comprising:

a body portion fabricated of a material compatible with that of the battery post and having means disposed for receiving the end of an electrically conductive cable and a pair of bifurcated spaced-apart ring portions defining the top and bottom of the body portion, each of said ring portions defining a circular opening therethrough in alignment with each other and having the center of these openings offset from the center of the outer circumferential circular outline surface of the ring portions and away from the cable receiving means; and a locking ring portion fabricated of a material compatible with that of the battery post and defining a circular opening therethrough of substantially the same diameter as the circular openings of the ring portions of the body portion and having a limited outer diameter and thickness to permit its accommodation between the ring portions of the body portion, the circles forming the circular opening and the outer circumferential outline of the locking ring portion being concentric, said locking ring further including lug means affixed juxtaposed the outer circumference of the locking ring portion and which extends perpendicularly beyond at least one of the surfaces through which the circular opening of the locking ring portion extends, the lug means for frictionally engaging the outer circumferential outline surface of at least one of the pair of bifurcated spaced-apart ring portions as the lug means is rotated toward the cable receiving means, thereby tightening the connector to the battery post by a force between the lug means and the outer circumferential outline surface which tends to cause the circular opening of the locking ring portion to be offset from the circular opening of the ring portions of the body portion.

2. A connector as in claim 1 wherein said body portion is molded to the cable.

3. A connector as in claim 1 wherein:

said body portion further includes a shank portion at the end opposite said ring portions, said shank portion defining a cavity for receiving said cable and a central channel of a smaller cross section coupling said cavity to the space between the bifurcated spaced-apart ring portions; and fastening means for extending through said channel into said cavity to force the cable against the interior surface of the cavity, the fastening means being concealed by the locking ring portion when in place.

4. A connector as in claim 1 wherein the circular openings defined by the ring portions of the body portion and of the locking ring portion are aligned and are sized to fit around a battery post with the lug means of the locking ring adjacent the end of the body portion.

5. A connector as in claim 1 wherein the circular opening defined by the locking ring portion and the circular openings defined by the ring portions of the body portion are non-concentric with the lug means juxtaposed the outer circumference of each of the ring portions of the body portion.

* * * * *